US009587427B2

(12) United States Patent
Webb

(10) Patent No.: US 9,587,427 B2
(45) Date of Patent: Mar. 7, 2017

(54) RESTRAINT SYSTEM FOR RESTRAINING A PANEL IN AN OPENING OF AN OUTDOOR STRUCTURE

(76) Inventor: Daniel Alan Webb, Corpus Christi, TX (US)

( * ) Notice: Subject to any disclaimer, the term of this patent is extended or adjusted under 35 U.S.C. 154(b) by 0 days.

(21) Appl. No.: 13/446,171

(22) Filed: Apr. 13, 2012

(65) Prior Publication Data

US 2013/0269271 A1 Oct. 17, 2013

(51) Int. Cl.
*E04G 21/28* (2006.01)
*E06B 9/02* (2006.01)
*E06B 9/00* (2006.01)

(52) U.S. Cl.
CPC ..... *E06B 9/02* (2013.01); *E06B 2009/005* (2013.01)

(58) Field of Classification Search
CPC .... E04F 2290/04; E04G 2021/24; E04H 9/04; E06B 3/00; E06B 3/28; E06B 3/30; E06B 3/5418; E06B 5/003; E06B 5/025; E06B 5/10; E06B 5/106; E06B 5/12; E06B 7/28; E06B 9/02; E06B 9/04; E06B 9/24; E06B 2007/28; E06B 2009/00; E06B 2009/005
USPC ..... 52/107, 202, 203, 764, 770, 773, 506.05
See application file for complete search history.

(56) References Cited

U.S. PATENT DOCUMENTS 1,850,815 A * 3/1932 Sullivan ..... 52/37
2,213,234 A * 9/1940 Tinnerman ..... F24C 15/12 126/39 B
3,205,601 A * 9/1965 Gawne et al. ..... 52/476
3,694,985 A * 10/1972 Spaiches ..... 52/764
4,215,517 A * 8/1980 Everson ..... 52/202
D259,393 S * 6/1981 Kuru ..... D8/380
4,355,676 A * 10/1982 Lee ..... 160/107
4,409,758 A * 10/1983 Dickerson et al. ..... 49/463
5,086,604 A * 2/1992 Orth ..... 52/202
5,634,618 A * 6/1997 Farmer et al. ..... 248/201
6,393,777 B1 * 5/2002 Renfrow ..... E06B 9/02 248/475.1
6,898,907 B2 * 5/2005 Diamond ..... 52/202
D669,773 S * 10/2012 Colasse ..... D8/395
8,966,839 B2 * 3/2015 Rebman et al. ..... 52/203
2008/0196333 A1 * 8/2008 Tyler ..... 52/204.63
2014/0352239 A1 * 12/2014 Cho ..... E06B 9/02 52/202
2015/0089873 A1 * 4/2015 Marsden ..... E06B 9/02 49/56

(Continued)

*Primary Examiner* — Rodney Mintz
(74) *Attorney, Agent, or Firm* — Karl L. Larson

(57) ABSTRACT

A restraint system for temporarily restraining a generally rectangular panel in an opening of an outdoor structure having a pair of longitudinally extending side portions, a base portion connected to each of the pair of longitudinally extending side portions at respective proximal ends of each of the pair of longitudinally extending generally parallel, inwardly inclined side portions, protruding members arranged along a bottom surface of the base portion for frictionally engaging a side portion of an opening of an outdoor structure during an operational use of the restraint system, and a tab portion configured to allow a user to grab and pull the restraint system out of the opening. The pair of longitudinally extending side portions and the base portion form a generally u-shaped configuration with a gap therebetween adapted for receiving a side portion of a generally rectangular panel.

10 Claims, 3 Drawing Sheets

(56) References Cited

U.S. PATENT DOCUMENTS

2015/0121781 A1* 5/2015 Nugent ..... E06B 9/02
52/202

* cited by examiner

RESTRAINT SYSTEM FOR RESTRAINING A PANEL IN AN OPENING OF AN OUTDOOR STRUCTURE

BACKGROUND OF THE INVENTION

Field of the Invention

The present invention is generally related to securing openings of outdoor structures, and more particularly to a restraint system for temporarily restraining a panel in an opening of an outdoor structure.

Discussion of the Background

Many types of outdoor structures such as houses, mobile homes, storage sheds are susceptible to high wind events caused by weather conditions such as storms, hurricanes, tornados and the like, and/or other weather elements such as floods and the like. These outdoor structures typically include one or more windows or openings which are susceptible to high wind events and/or other weather elements until the windows or openings are secured. For example, debris from a sudden or unexpected wind gust could damage the interior of the outdoor structure. Other types of outdoor structures also suffer from similar deficiencies relating to sudden or unexpected high wind events and/or other weather elements.

Thus, there currently exist deficiencies associated with securing openings of outdoor structures, and, in particular, with protecting such openings from high wind events and/or other weather elements caused by weather conditions.

SUMMARY OF THE INVENTION

Accordingly, one aspect of the present invention is to provide a restraint system for temporarily restraining a generally rectangular panel in an opening of an outdoor structure. The restraint system includes a pair of longitudinally extending side portions, a base portion connected to each of the pair of longitudinally extending side portions at respective proximal ends of each of the pair of longitudinally extending side portions, one or more protruding members arranged along a bottom surface of the base portion for frictionally engaging a side portion of an opening of an outdoor structure during an operational use of the restraint system, and a tab portion connected to the outer surfaces of the base portion and the distal end of one of the pair of longitudinally extending side portions, and extending away at an angle therefrom. The pair of longitudinally extending side portions and the base portion form a generally u-shaped configuration with a gap therebetween adapted for receiving a side portion of a generally rectangular panel. The longitudinally extending side portions are generally parallel and inwardly inclined towards respective distal ends of the longitudinally extending side portions forming a resilient bias to frictionally engage the generally rectangular panel. The tab portion being configured to allow a user to grab and pull the restraint system out of the opening of the outdoor structure after the operational use of the restraint system.

Another aspect of the present invention is to provide a apparatus for protecting an opening in an outdoor structure. The apparatus including a clip having a pair of generally parallel side portions and a base portion in a generally u-shaped configuration with a gap therebetween adapted for receiving a side portion of a panel, resilient bias means for frictionally securing the panel within the gap, and frictional engagement means for frictionally engaging a surface containing an opening of an outdoor structure during an operational use of the apparatus.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION OF THE PREFERRED EMBODIMENTS

Figure 1:
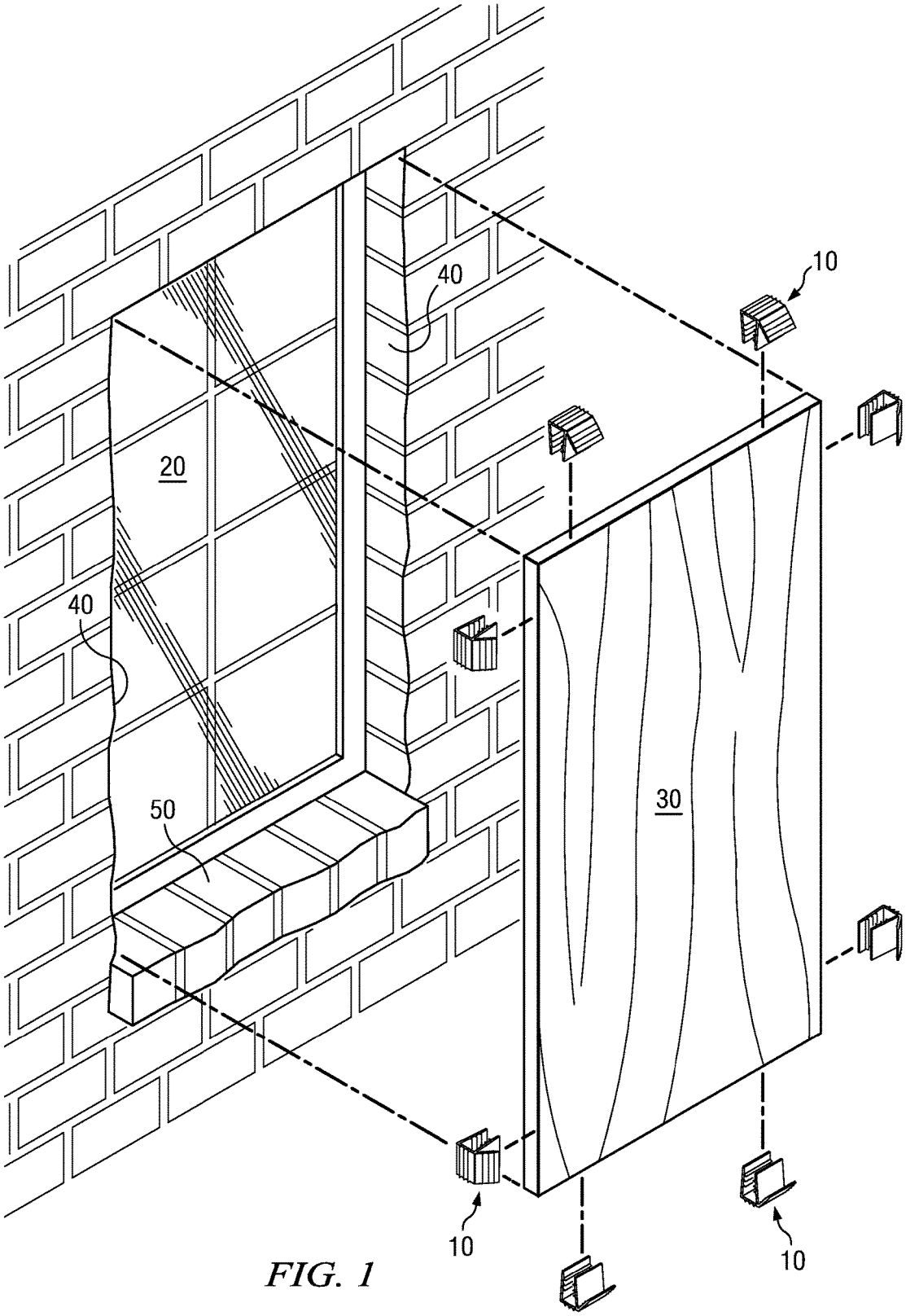
FIG. 1 shows a perspective view of a window with wind restraining devices prior to installation in accordance with an embodiment of the present invention.

Referring now to the drawings, wherein like reference numerals designate identical or corresponding parts throughout the several views, preferred embodiments of the present invention are described.

Many types of outdoor structures such as houses, mobile homes, storage sheds are susceptible to high wind events caused by weather conditions such as storms, hurricanes, tornados and the like, and/or other weather elements such as floods and the like. In fact, it is well known in the art that the first line of defense to protect an outdoor structure against a high wind event and/or other weather element is to secure the windows or openings of the outdoor structure which are susceptible to high wind events and/or other weather elements. As is known in the art, securing windows or openings is typically done by means of securing one or more pieces of plywood or the like into those windows or openings. When the high wind event and/or other weather element occur, the plywood securing the windows or openings should not be removed until the wind has died down to a safe level. Without such additional support, debris and/or other objects might sail, fly or ram through the windows or openings causing damage the interior of the outdoor structure if the wind is strong enough.

Additionally, openings for both outdoor and indoor structures many need to be secured against vandalism and/or other non-natural disasters when the structure is vacant.

Figure 2:
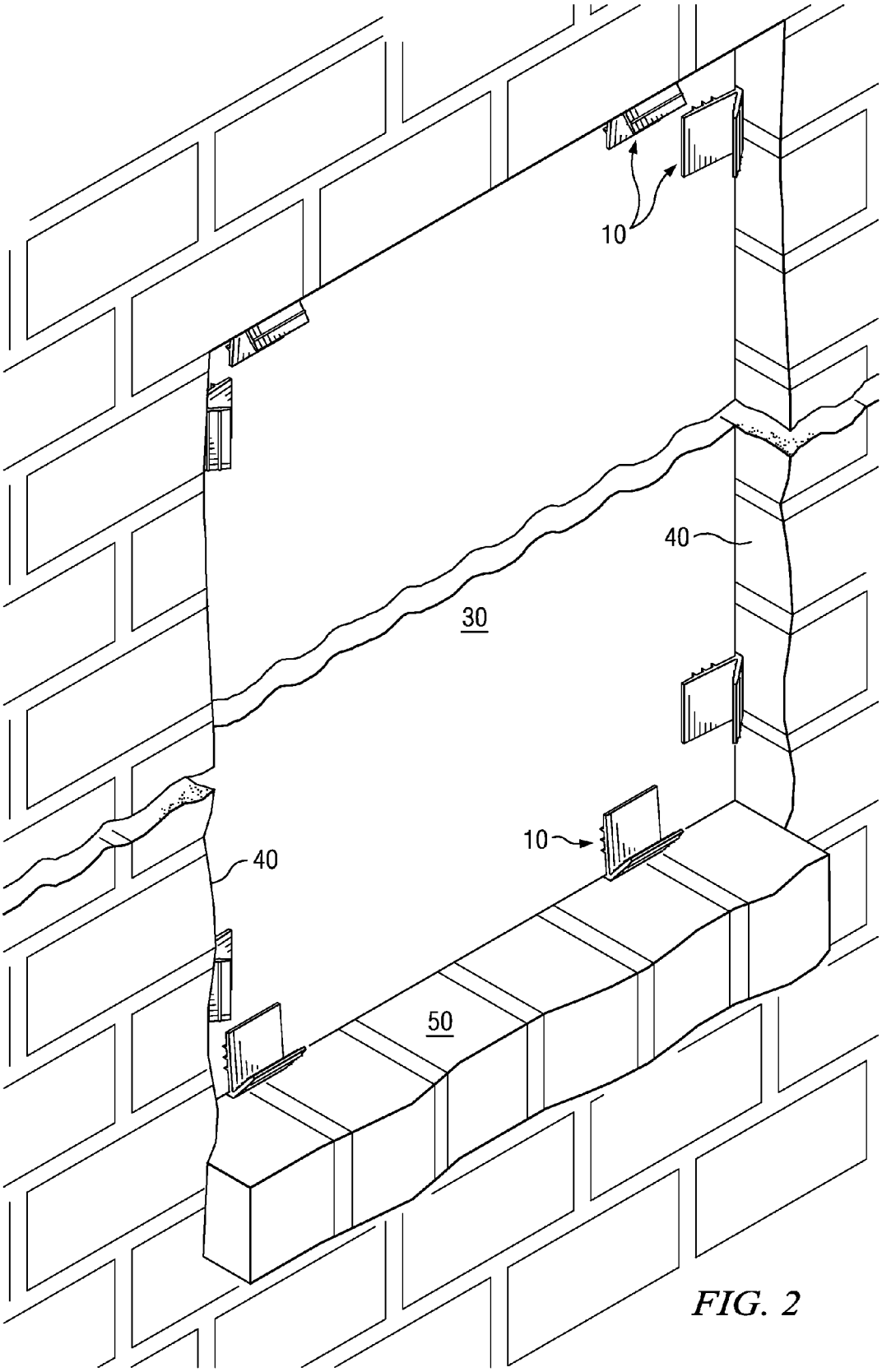
FIG. 2 shows a perspective view of a window with wind restraining devices in operational position in accordance with an embodiment of the present invention.

Referring to FIG. 1, a perspective view of a window 20 with plural wind restraining devices 10 prior to installation in accordance with an embodiment of the present invention is shown. During installation, one or more wind restraining devices 10 are secured along the side perimeter of a plywood panel 30. As is known in the art, the plywood panel is cut or sized to approximately slightly less than the opening provided by the window seal formed by side and upper portions 40 and bottom portion 50 of the surrounding window 20. The wind restraining devices 10 and plywood panel 30 are placed into an operational position in the window seal (40 and 50). A perspective view of a window with wind restraining devices in operational position in accordance with an embodiment of the present invention is shown in FIG. 2.

Figure 3:
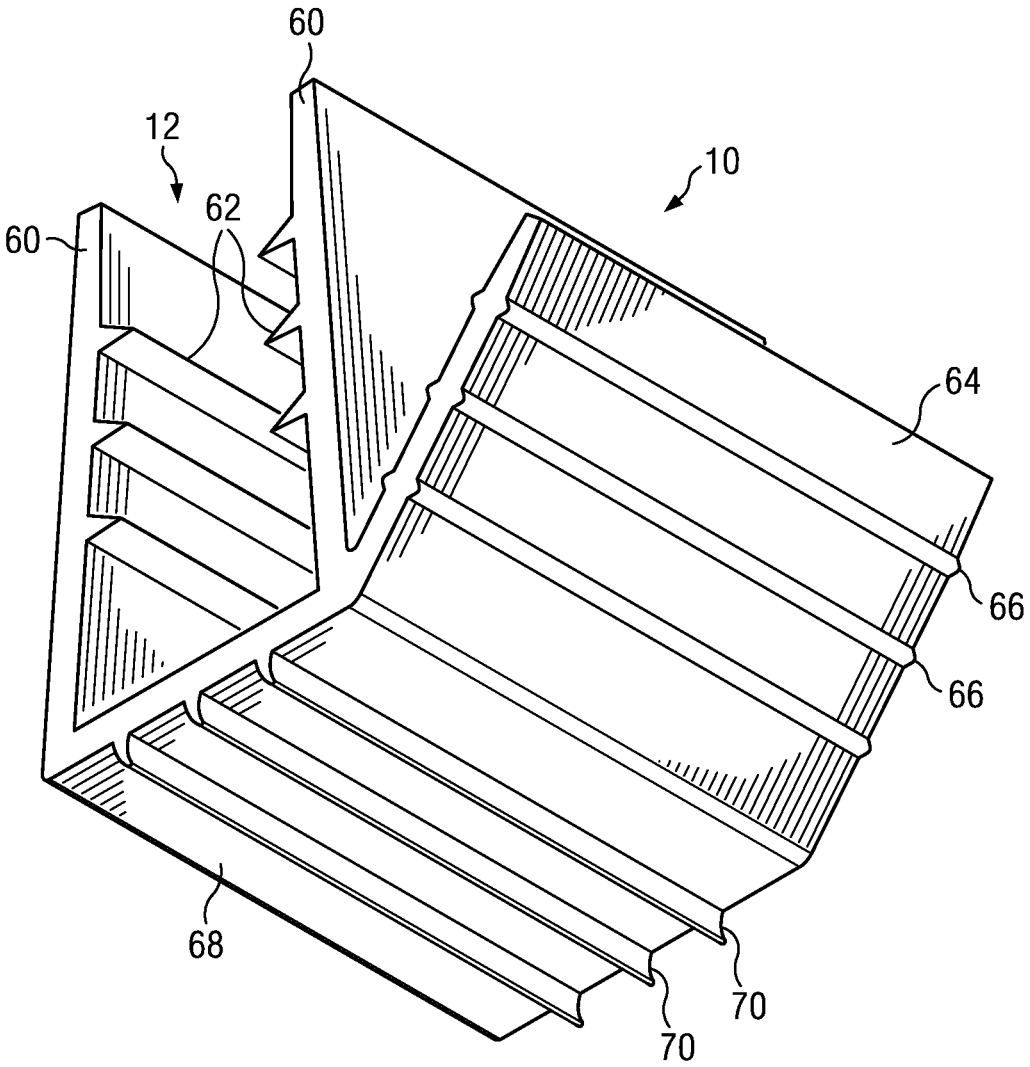
FIG. 3 shows a perspective view of wind restraining device in accordance with an embodiment of the present invention.

Referring to FIG. 3, a perspective view of a wind restraining device 10 in accordance with an embodiment of the present invention is shown. The wind restraining device 10 has a generally U-shape having a pair of generally parallel inwardly inclined side portions 60 and joined together by a base portion 68. The generally parallel inwardly inclined side portions 60 are slightly inclined towards each other with the distal ends of the generally parallel side portions 60 being slightly closer with respect to each other than their respective proximal ends forming a natural spring. Optionally, generally parallel inwardly inclined side portions 60 each include one or more generally parallel protruding members 62 or "teeth" which are transversely aligned along the length of their respective inner surfaces. The one or more generally parallel protruding members 62 may be configured on both or either side portions within the scope of the invention. The generally parallel inwardly inclined side portions 60 act as a spring, and together with the one or more protruding members 62 serve to retain a plywood panel between the gap 12 formed therebetween by means of compression or ratchet grip.

Base portion 68 may include one or more externally protruding members 70 or "teeth" along a lower surface of the base portion 68. The one or more externally protruding members 70 serve to at lock the plywood panel and the one or more wind restraining devices 10 within the opening provided by the window seal formed by side and upper portions 40 and bottom portion 50 of the surrounding window 20 by means of compression or ratchet grip.

The wind restraining device 10 includes an optional tab member 64 which angularly protrudes away from base portion 68 and one of the generally parallel inwardly inclined side portions 60. The optional tab member many include one or more generally parallel protruding members 66. The optional tab member 64 is configured to allow a user to remove the wind restraining device 10 along with the plywood contained therebetween from the window seal.

As shown in FIG. 3, base portion 68 is a generally flat surface. However, base portion 68 may be a curved or arched surface within the scope of the present invention. Additionally, generally parallel inwardly inclined side portions 60 are shown as generally straight surfaces. However, generally parallel inwardly inclined side portions 60 may also be slightly curved or arched within the scope of the present invention.

According to at least one embodiment, the wind restraining device 10 is a low density polyethylene extrusion. Polyethylene has a quality referred to as "memory" which causes any deformation to tend to return to its original configuration after pressure is released. This allows the one or more externally protruding members 70 or "teeth" along a lower surface of base portion 68 to return to their original angular position after operational use and removal of the wind restraining device 10. It also provides a natural spring between the generally parallel inwardly inclined side portions 60 with memory to return to its original configuration after operational use. Further, the low density polyethylene extrusion is soft enough to not damage the window seal during its operational use. Other similar materials, plastics and the like may also be utilized within the scope of the present invention. The wind restraining device 10 may also be a unified extrusion or multiple combined parts (or portions) within the scope of the present invention.

Although not preferred, according to other possible embodiments, the wind restraining device 10 may be comprised of harder materials within the scope of the present inventions. Further, one or more springs may be utilized instead of a natural spring within the scope of the present invention.

According to one embodiment, the wind restraining device 10 is configured to fit plywood panels of ⅜ inch, ½ inch, ⅝ inch and ¾ inch depths without modification or reshaping. Plywood panels of other widths may also be configured to fit within the scope of the present invention by sizing the gap 12 provided between the generally parallel inwardly inclined side portions 60 to the appropriate size required to fit the depth of the plywood panel desired.

During operation, a plywood panel is slid between side portions 60 until the plywood reaches an upper side of base portion 68. The slightly inclined parallel side portions 60 and one or more protruding members 62 serve to retain the plywood panel in place. Similarly, one or more additional wind restraining devices 10 are attached along different sides of the plywood panel. The plywood panel and the wind restraining devices 10 are then seated in a window seal to provide greater protection from weather elements. The wind restraining devices 10 and the plywood panel therebetween may be unseated (removed) from the window seal by a user using the tab member 64.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

Obviously, many other modifications and variations of the present invention are possible in light of the above teachings. The specific embodiments discussed herein are merely illustrative, and are not meant to limit the scope of the present invention in any manner. It is therefore to be understood that within the scope of the disclosed concept, the invention may be practiced otherwise then as specifically described.

The invention claimed is:

1. A restraint system for temporarily restraining a rectangular panel in an opening of an outdoor structure, comprising:

the rectangular panel positioned in the opening of the outdoor structure; and a plurality of clips, each said clip including:

a pair of longitudinally extending side portions;

a base portion connected to each of the pair of longitudinally extending side portions at respective proximal ends of each of the pair of longitudinally extending side portions, wherein the pair of longitudinally extending side portions and the base portion form a substantially u-shaped configuration with a gap therebetween adapted for receiving a side portion of the rectangular panel, and wherein the longitudinally extending side portions are substantially straight and parallel, and inwardly inclined towards respective distal ends of the longitudinally extending side portions forming a resilient bias to frictionally engage the rectangular panel during an operational use of the restraint system, wherein the base portion and the pair of longitudinally extending side portions are comprised of a low density polyethylene material having a memory property capable of returning the clip to an original configuration when an applied pressure is released such that the pair of longitudinally extending side portions return to an original inwardly inclined angular position after the operational use of the restraint system;

one or more first protruding members arranged along a bottom surface of the base portion for frictionally engaging a side portion of the opening of the outdoor structure during the operational use of the restraint system; and a tab portion having a substantially straight shape and integrally formed at an intersection between outer surfaces of the base portion and the proximal end of one of the pair of longitudinally extending side portions, and extending away at a non-perpendicular angle therefrom, the tab portion being configured to allow a user to grab and pull the restraint system out of the opening of the outdoor structure after the operational use of the restraint system, wherein tab potion is not parallel to the base portion, and wherein the base portion, the pair of longitudinally extending side portions, the one or more protruding members and the tab portion form a unitary structure of one-piece construction composed of a single piece of material for temporarily restraining the rectangular panel in the opening of the outdoor structure.

2. The system of claim 1, further comprising one or more second protruding members arranged along respective surfaces facing the gap of at least one of the pair of longitudinally extending side portions for frictionally engaging the rectangular panel during the operational use of the restraint system.

3. The system of claim 2, further comprising one or more third protruding members arranged along an outer surface of the tab portion for providing additional frictional engagement to the user when grabbing or pulling the restraint system out of the opening of the outdoor structure.

4. The system of claim 2, wherein the rectangular panel comprises a plywood panel.

5. The system of claim 2, wherein the rectangular panel comprises a metal panel.

6. The system of claim 2, wherein the rectangular panel comprises a composite panel.

7. The system of claim 2, wherein the rectangular panel comprises a plastic panel.

8. The system of claim 2, wherein the polyethylene material is a low density polyethylene extrusion.

9. The system of claim 2, wherein the operational use of the restraint system is configured to provide protection during at least one event selected from the group consisting of a hurricane weather event, a flood weather event, and a tornado weather event.

10. The system of claim 2, wherein the restraint system is configured to provide protection from debris caused by high winds during the operational use of the restraint system.

* * * * *